US006019451A

United States Patent [19]

Kawaguchi et al.

[11] Patent Number: 6,019,451

[45] Date of Patent: Feb. 1, 2000

[54] INK JET RECORDING APPARATUS WITH CAPPING MECHANISM AND CAPPING STATE INDICATOR

[75] Inventors: Koichiro Kawaguchi, Yokohama; Koji Terasawa, Mitaka; Katsuyuki Yokoi, Yokohama; Makoto Takemura, Tokyo; Hideo Fukazawa, Yokohama, all of Japan

[73] Assignee: Canon Kabushiki Kaisha, Tokyo, Japan

[21] Appl. No.: 08/429,467

[22] Filed: Apr. 27, 1995

Related U.S. Application Data

[63] Continuation of application No. 07/921,744, Jul. 30, 1992, abandoned.

[30] Foreign Application Priority Data

Jul. 31, 1991 [JP] Japan ..... 3-213160
Jul. 31, 1991 [JP] Japan ..... 3-213161

[51] Int. Cl.[7] ..... B41J 2/165

[52] U.S. Cl. ..... 347/29; 347/32

[58] Field of Search ..... 347/29, 32, 22, 347/23, 30

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,410,900 | 10/1983 | Terasawa | 347/30 |
| 4,450,454 | 5/1984 | Koto | 346/140 R |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,631,554 | 12/1986 | Terasawa | 347/30 |
| 4,701,771 | 10/1987 | Ikeda | 346/140 R |
| 4,723,129 | 2/1988 | Endo et al. | 347/56 |
| 4,728,970 | 3/1988 | Terasawa | 347/30 |
| 4,740,796 | 4/1988 | Endo et al. | 347/56 |
| 4,926,196 | 5/1990 | Mizoguchi et al. | 346/140 R |
| 4,930,101 | 5/1990 | Wong et al. | 364/900 |
| 4,951,066 | 8/1990 | Terasawa et al. | 347/33 |
| 4,970,534 | 11/1990 | Terasawa et al. | 347/32 |
| 5,070,346 | 12/1991 | Mochizuk et al. | 346/140 R |
| 5,126,766 | 6/1992 | Terasawa et al. | 347/30 |
| 5,479,194 | 12/1995 | Hirano et al. | 347/22 |

FOREIGN PATENT DOCUMENTS

| | | | |
|---|---|---|---|
| 0289743 | 11/1988 | European Pat. Off. . | |
| 58-119867 | 7/1983 | Japan . | |
| 58-194564 | 11/1983 | Japan . | |
| 59-123670 | 7/1984 | Japan . | |
| 59-138461 | 8/1984 | Japan . | |
| 3-234637 | 10/1991 | Japan | 347/29 |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus means ink is discharged from a recording head onto a recording material for recording. The ink jet recording apparatus has a cap for closing an ink discharge portion of the recording head, and a device for indicating that the ink discharge portion has been closed with the cap.

31 Claims, 9 Drawing Sheets

INK JET RECORDING APPARATUS WITH CAPPING MECHANISM AND CAPPING STATE INDICATOR

This application is a continuation of application Ser. No. 07/921,744 filed Jul. 30, 1992, now abandoned.

BACKGROUND OF THE INVENTION

1. Field of the Invention

The present invention relates to an ink jet recording apparatus wherein ink is discharged from a recording means to a recording material for recording.

2. Related Background Art

Recording apparatuses having functions of printers, copying machines, facsimile equipment, etc. or recording apparatuses used as output equipment for composite electronic equipment including computers and word processors and workstations are constructed so as to record images on a recording material (recording medium) such as paper, plastic sheets, etc. on the basis of image information. Said recording apparatuses are divided into ink jet type, wire dot type, thermal type, laser beam type, etc. according to recording systems.

In serial type recording apparatuses employing a serial scan system wherein main scanning is performed in a direction across the direction of feeding of a recording material (direction of sub-scanning), after setting the recording material in a predetermined recording position, an image is recorded (main scanned) by a recording means mounted on a carriage which moves along the recording material; after recording for one line has been completed, a paper conveyance or feed of a predetermined amount (pitch feed) is performed; then, an image for a next line is recorded (main scanned) on the recording material, the feeding of which is again halted; and such recording and feeding operations are repeated for recording on the entire recording material. Meanwhile, in line type recording apparatuses wherein recording is made only by sub-scanning in the direction of feeding of a recording material, after setting the recording material in a predetermined position and recording one line at a time, a paper feed of a predetermined amount (pitch feed) is performed, and again, for a next line is recorded at one time; and such recording and feeding operations are repeated for recording on the entire recording material.

Among recording apparatuses described above, ink jet type recording apparatuses (ink jet recording apparatuses) record by discharging ink from a recording means (recording head) to a recording material and have such features that a compact recording means is easy to implement, high-definition images can be recorded at a high speed, recording can be made on plain paper without requiring special treatment thereon, a running cost is cheap, noise is less because it is of non-impact type, and it is easy to record color images by using multicolor ink. In particular, line type recording apparatuses, which use a line type recording means with many discharge ports arranged across the width of paper, can implement recording at higher speeds.

Especially, as for ink jet type recording means (recording heads) which utilize thermal energy for discharging ink, it is easy to manufacture models having highly dense liquid path arrangements (discharge ports/arrangements) by forming electrothermal conversion bodies, electrodes, liquid path walls, top plates, etc. in the form of a film on a board through semiconductor manufacturing processes such as etching, vapor deposition, sputtering, etc.; thus, the recording means can be made more compact. On the other hand, there are various demands on recording materials; in recent years, it has been required to use thin paper and processed paper (paper with punched holes for filing, paper with perforations, paper in nonstandard shape, etc.) in addition to ordinary recording materials including paper and thin resin sheets (for use with OHP, etc.).

In ink jet recording apparatuses described above, if foreign matter such as paper dust, other dust or the like adheres to an ink discharge portion, or if ink in a discharge port portion increases in viscosity or gets stuck due to drying, discharge problems (including nondischarging) may result; to prevent such problems, employed is the method of closing the ink discharge portion with a cap when recording is not effected. The cap is usually formed from rubber-like elastic material.

Ink jet recording apparatuses described above are constructed so as to automatically execute various sequences for stabilizing discharge from a recording head; if recording apparatus power is turned off by a user inadvertently or for any other causes, closing an ink discharge portion with a cap (capping) has failed in some cases. If a recording apparatus is transported or left unused for a long period of time in the state that closing an ink discharge portion with a cap (capping) is not securely done, it is more likely that discharge problems will occur due to ink leakage from a discharge port or ink sticking or an increase in ink viscosity within a discharge port in transit, and also that vibrations or the like will cause air to enter a meniscus portion. Hence, for preventing incomplete capping, conventional ink jet recording apparatuses not only inhibit power from being turned off during recording but employ the method of turning power off after waiting for a time required for secure capping, or the method of turning power off on detecting the completion of capping by means of a mechanical operating sound. In addition, in recording apparatuses having a power off sequence, a series of sequences is always executed after a recording apparatus power has been turned off, and hence, a substantially long waiting time has been needed, and a power cord has been unable to be disconnected from an outlet during executing the series of sequences.

However, in aforementioned ink jet recording apparatuses, it is difficult to judge under a black box state whether a recording head is in a capped state, and thus, a user has been required to wait for a longer time than needed. Also, when a recording apparatus is in an on-line state, recording will start at an indefinite time under a command for recording from a host such as a personal computer or the like, and hence, a recording apparatus system is so constructed that a cap is left open for up to a predetermined period of time for quick response to a next command for recording. As a result, it is very difficult to judge whether a cap is open or closed, and consequently, it has been likely to turn power off with the cap being left open.

Also, even when a recording apparatus is in an off-line state, the operation of the recording apparatus itself may be executed for stable discharge from discharge ports; even in such a case, it is difficult to judge the state of a cap, and consequently, it has been likely to turn power off with the cap being left open. In addition, even for recording apparatuses having a power off sequence, there has been the problem to be solved that a waiting time after turning power off is long, and hence, an apparatus cost increases, and an extra space is needed.

In addition, in recent years, portable type ink jet recording apparatuses have been developed for easy carrying. For such portable type ink jet recording apparatuses, the necessity of capping ink discharge ports is much greater because of a diversity of handling the apparatuses when the apparatuses are carried. However, the above-noted power off sequence requires portable type ink jet recording apparatuses to have a built-in backup power source, and hence, there has been a difficulty in reducing the size and weight of the apparatuses.

SUMMARY OF THE INVENTION

An object of the present invention is to provide an ink jet recording apparatus wherein in order to solve the above-noted problem of the prior art, by notifying an operator of the state whether a recording head is closed with a cap or not, the recording head can always be closed with the cap when the recording apparatus is not used.

Another object of the present invention is to provide an ink jet recording apparatus, wherein ink is discharged from a recording means to a recording material for recording, having means for notifying a user that a cap for closing therewith an ink discharge portion of a recording means is in an open state.

A further object of the present invention is to provide an ink jet recording apparatus which enables a user to easily determine the timing of turning power off by notifying the user that a cap for closing therewith a recording head is in an open state or in a state immediately before the open state, thereby preventing recording apparatus power from being turned off in the state of recording head's being open, either in on-line or off-line state, attaining subsequent discharge stability of a recording head, and preventing ink leakage in transit or the like.

Still another object of the present invention is to provide an ink jet recording apparatus, wherein ink is discharged from a recording means to a recording material for recording, having a cap for closing therewith an ink discharge portion of a recording means, and having means for indicating that the ink discharge portion has been closed with said cap, thereby enabling a user to quickly recognize that capping has been securely executed.

A still further object of the present invention is to provide an ink jet recording apparatus which employs the construction that the operation of closing an ink discharge portion with a cap is executed by a panel operation, or the construction that the operation of closing the ink discharge portion with said cap is executed with a command, or the construction that a user is notified by a buzzer and an indication that the ink discharge portion has been closed with said cap, thereby being able to forcibly and more securely execute a capping operation, and enabling an operator in a production line and a user or the like to more quickly and securely recognize that capping has completed.

DETAILED DESCRIPTION OF THE PREFERRED EMBODIMENTS

Figure 1:
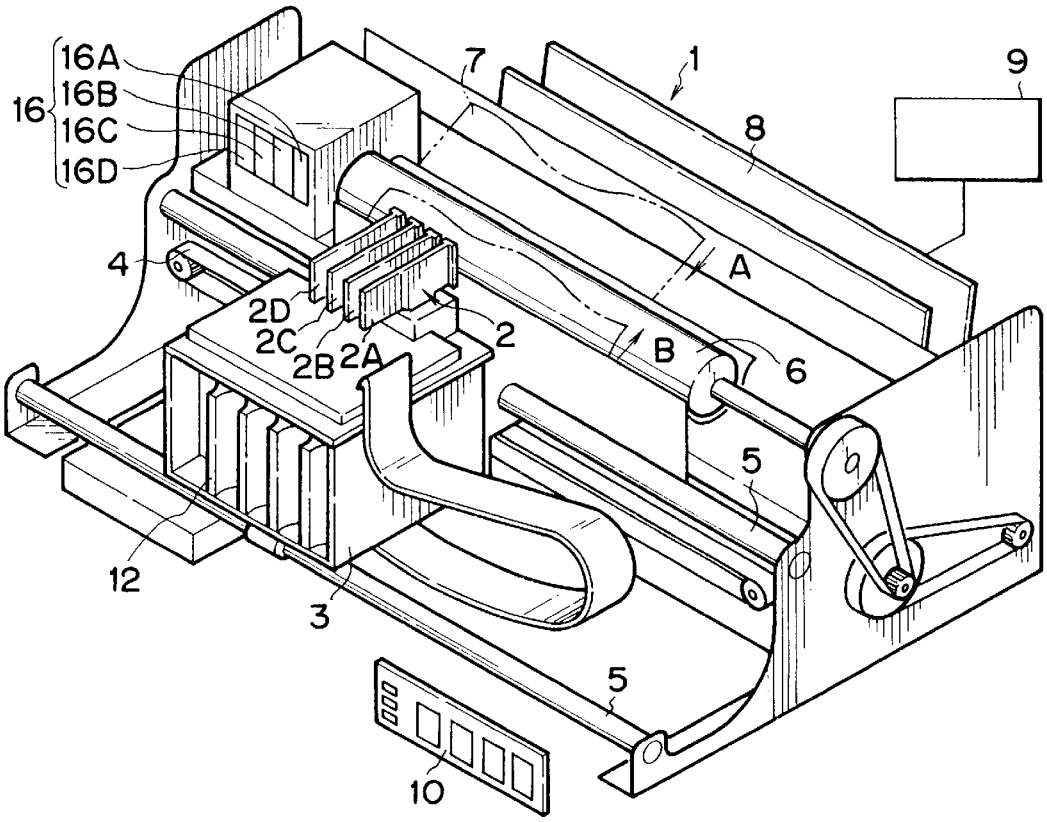
FIG. 1 is a perspective view showing the construction of the essential portions of an embodiment of an ink jet recording apparatus to which the present invention is applied.

Embodiments of the present invention will hereinafter be described in detail with reference to the drawings. FIG. 1 is a perspective view showing an embodiment of an ink jet recording apparatus to which the present invention is applied. In FIG. 1, an ink jet recording apparatus 1 is so constructed that ink is discharged from a recording means 2 to a recording material 7 such as paper, a thin plastic sheet or the like for recording. Furthermore, FIG. 1 shows the case of an ink jet recording apparatus for color recording; the recording means 2 comprises a plurality of (four) recording heads 2A, 2B, 2C, and 2D; ink colors, for example, of yellow (Y), magenta (M), cyan (C), and black (Bk) are used for these recording heads.

In FIG. 1, said recording means (recording head) 2 is mounted on a carriage 3, and said carriage 3 is mounted for reciprocating movement (main scanning) on guide rails 5 and 5 being located in parallel along the recording material 7. Said carriage 3 is driven by a motor, not shown, through a timing belt 4 being extended between a pair of pulleys. A platen (a platen roller in an illustrated example) 6 with a length covering almost entire recording area is pivoted for rotation in a position facing the recording head 2. This platen roller 6 also serves as a feed roller for feeding paper; the recording material 7 is fed along the surface of the platen roller 6 in the direction of arrow A and ejected in the direction of arrow B after passing a recording position.

In a position adjacent a recording area within the range of movement of the recording head 2 (at the left of the platen roller 6 in the illustrated example), a recovery mechanism 11 is provided for securing the stability of ink discharge from said head 2 and preventing ink from getting stuck in the case of being left unused for a long period of time. A cap 16 is provided on the front surface of this recovery mechanism 11 for closing (capping) therewith a discharge ports formed surface (ink discharge portion) of each recording head 2 when no recording is made. In the illustrated example, this cap 16 also comprises a plurality of caps 16A, 16B, 16C, and 16D in correspondence with a plurality of recording heads 2A through 2D, respectively. These caps 16A through 16D themselves are usually formed from rubber-like elastic material for closing (sealing) the discharge ports formed surface in a hermetic state. Proposed mechanisms for pressing these caps 16A through 16D against the discharge ports formed surface include a mechanism for moving the recovery mechanism 11 toward and away from the recording head 2, and a mechanism for pressing the caps 16A through 16D against the discharge ports formed surface by means of movement of the carriage 3.

In FIG. 1, the recording apparatus 1 is provided with a control unit 8 having a controller 15 (FIG. 4) for controlling the operation of said recovery mechanism 11, the operation of said carriage 3, the operation of said platen roller 6, the recording operation (ink discharge) of each recording head 2, and so on. Also, said controller 15 is connected to a host 9 such as a computer, a word processor or the like for sending thereto commands (instruction signals), image data (recording signals) and the like from the host 9.

A replaceable ink cartridge 12 is mounted on said carriage 3 for feeding ink in colors corresponding to individual recording heads 2A through 2D. Also, a panel 10 having various switches and various indicators is provided on the front surface of the recording apparatus 1.

Said recording head 2 (each of recording heads 2A through 2D) is a recording means that utilizes thermal energy for discharging ink, and has electrothermal conversion bodies for generating thermal energy. Also, said recording head 2 utilizes pressure changes that take place with the growth and contraction of a bubble derived from film boiling caused by thermal energy applied by said electrothermal conversion body, thereby discharging ink from a discharge port for recording.

Figure 2:
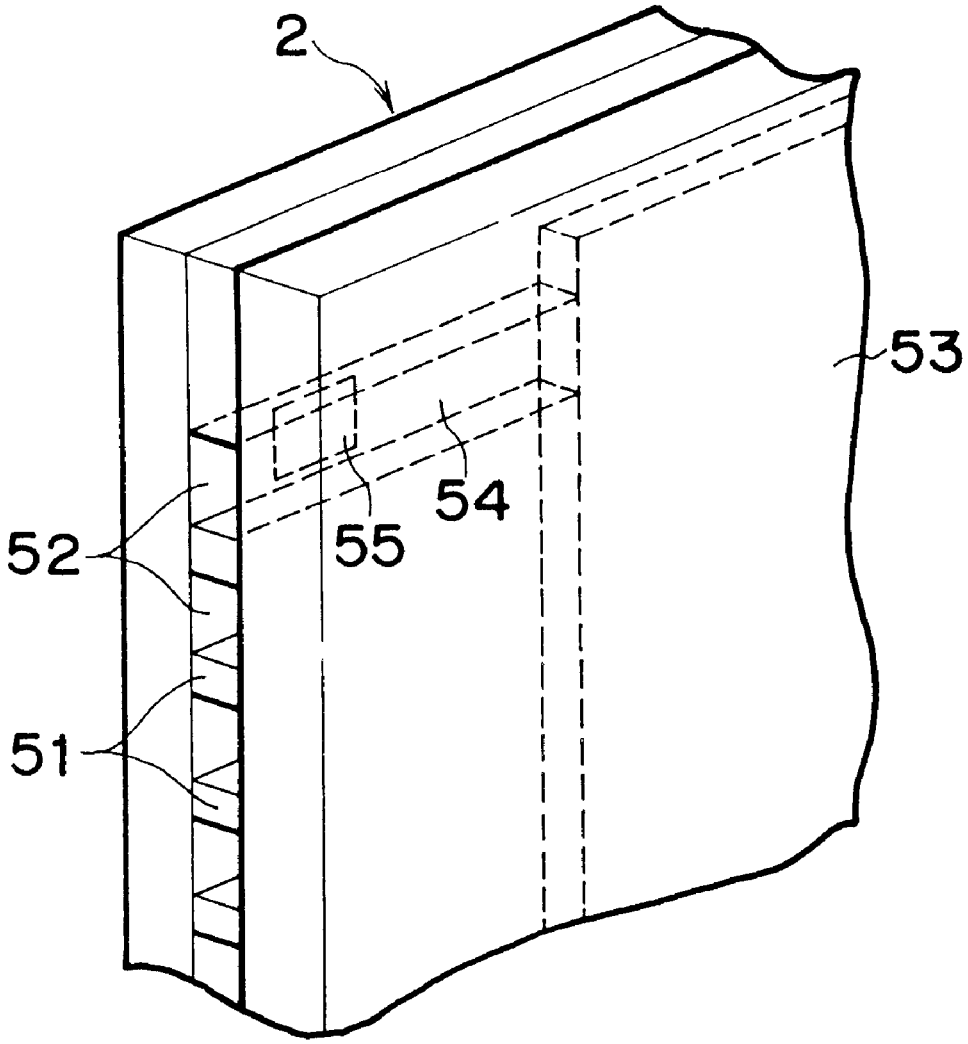
FIG. 2 is a partial perspective view schematically showing the structure of an ink discharge portion of a recording head shown in FIG. 1.

FIG. 2 is a partial perspective view schematically showing the structure of the ink discharge portion of said recording head 2. In FIG. 2, a plurality of discharge ports 52 are formed at a predetermined pitch in a discharge ports formed surface 51 facing the recording material 7 at a predetermined clearance (for example, about 0.5 to 2.0 millimeters) in between, and an electrothermal conversion body (heating resistor or the like) 55 is disposed along the wall surface of each liquid path 54 connecting a common liquid chamber 53 and each discharge port 52. In this example, the recording head 2 is mounted on said carriage 3 for the positional relation that said discharge ports 52 are disposed in a direction across the scanning direction of the carriage 3. Thus, constructed is the recording head 2 wherein a corresponding electrothermal conversion body 55 is driven (energized) on the basis of an image signal or a discharge signal for film boiling ink in the liquid path 54, and a resultantly built pressure causes ink to be discharged from the discharge port 52.

If the ink jet recording apparatus described above is shipped or transported without closing the recording head 2 with the cap 16, the head difference between the recording head 2 and the ink cartridge 12 may cause ink to leak from discharge ports 52 during handling, and also, discharge problems may occur at subsequent recording due to an increase in viscosity of or the sticking of ink in the discharge ports 52 or adhesion of dust or the like to the discharge ports formed surface; such problems need to be prevented.

Figure 3:
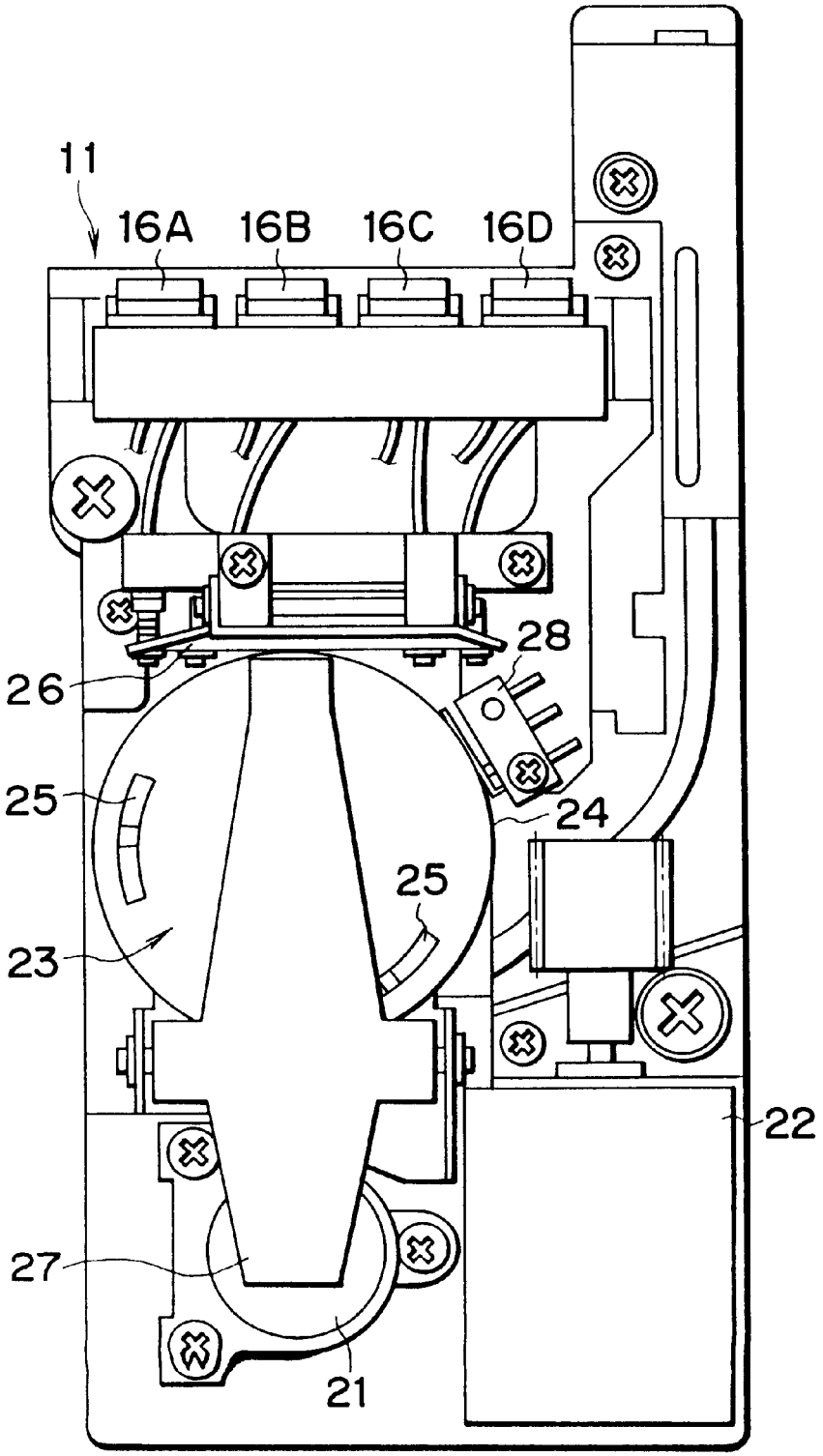
FIG. 3 is a partial enlarged plan view showing the construction of a recovery mechanism shown in FIG. 1.

FIG. 3 is a plan view showing the construction of the recovery mechanism 11 for preventing and solving above-noted discharge problems. In FIG. 3, said caps 16A through 16D are mounted on the front surface of the recovery mechanism 11 for forward and backward movement, and a recovery pump 21 is provided inside the recovery mechanism 11. This recovery pump, in a capping state, sucks ink from the discharge ports 52, and sucks waste ink from the cap 16 for discharge. The capping operation (forward and backward) of said cap 16 and the sucking operation of said recovery pump 21 are controlled and driven by a recovery motor 22 and a rotating cam plate 23 that is driven by said motor. A circular cam 24 for driving the cap 16 and a projection cam 25 for driving the said pump 21 are formed on said rotating cam plate 23. The displacement of said circular cam 24 causes the cap 16 to move forward and backward through a rotating lever 26. Said pump 21 is driven by said projection cam 25 through a pump lever 27.

Also, the recovery mechanism 11 is provided with a switch 28 for detecting the state of capping (open or close) from the position of rotation of said circular cam 24, and the state of capping is judged from on-off of said switch 28. Furthermore, feasible means for detecting the open-close state of the cap 16 include means for detecting capping (close state) from the on-off operation of an additionally provided switch for opening the cap and a step count of the motor (pulse motor) 22 of the recovery mechanism 11, and means for detecting the state of capping from the position of the carriage 3 in the construction that the movement of said carriage 3 causes a lever or the like to be pressed for capping the recording head 2.

Figure 4:
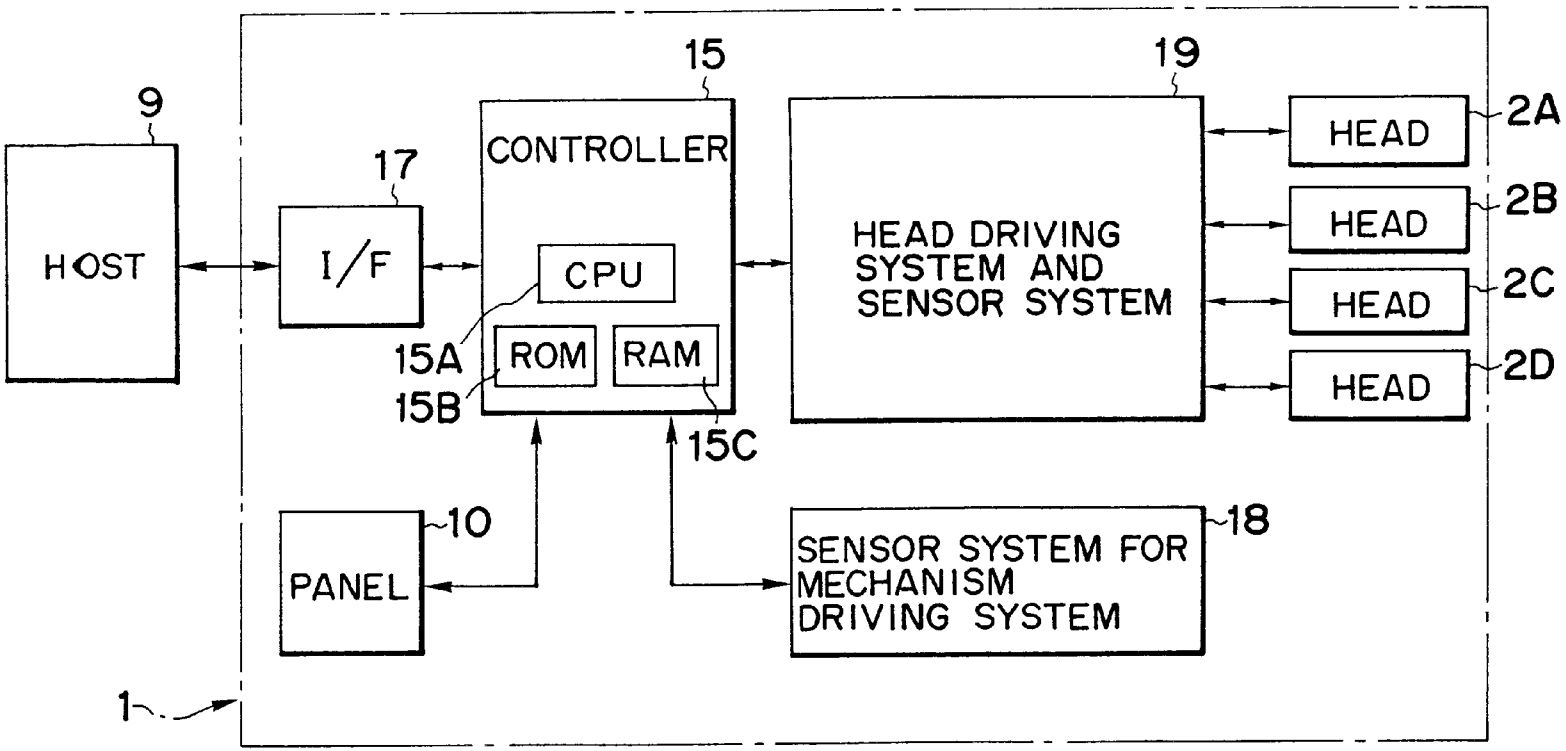
FIG. 4 is a block diagram showing an example of the construction of the essential portions of a control system of an ink jet recording apparatus to which an embodiment according to the present invention is applied.

FIG. 4 is a block diagram showing an example of construction for controlling the open-close operation of the cap 16 and indicating the open-close state of said cap. In FIG. 4, the controller 15 of the recording apparatus 1 is provided with a CPU 15A, a ROM 15B and a RAM 15C, and this controller 15 is connected to a host 9 such as a computer or the like through an interface 17. Also, according to construction employed, said controller 15 is connected to said panel 10 and a mechanism driving system and sensor system 18 for mutually exchanging signals. Moreover, according to construction employed, said controller 15 is connected to said recording heads 2A through 2D through a head driving system and sensor system 19 for controlling the recording operation of the recording heads 2A through 2D while mutually exchanging signals.

The state of capping controlled by the controller 15 is indicated on said panel 10. In other words, in an on-line state, when data is transferred from the host 9 to the controller 15, said controller 15 issues a command for recording and executes the driving of the carriage 3, a paper feed mechanism, etc. and detection with sensors at operating portions, and the current state of operations under control thereof is indicated on the panel 10. In this on-line state, since a data transportation or transfer from the host 9 is conducted at an indefinite time, control needs to be exercised so that a recording operation can be performed immediately in response to a data transfer. Hence, according to construction employed, mechanisms not directly participating in a recording operation such as a capping mechanism are put idle, and if a command for recording is not issued for over a predetermined time, a capping operation is performed for stabilizing discharge from the recording head 2.

When it is difficult to judge whether the cap 16 is in an open state or a close state, or when the cap 16 fails to enter a close state due to a halt of operation of the carriage 3, a user cannot precisely judge for himself/herself the timing of turning power off; hence, construction needs to be such that an indicator indicates the close state and other state of operation of the cap 16 for secure notification to a user.

Also, in an off-line state, there arises a case wherein the carriage 3 is put in halt for preliminarily discharging ink into the cap 16 for discharging stability, the inside of the cap 16 is exposed to air every predetermined operation of the carriage, or ink is sucked idly from inside the cap 16; in such a case, it is necessary to notify a user whether the cap 16 is open or closed.

Also, during a recording operation, there arises a case wherein the carriage 3 is evacuated outside a recording area for wiping (cleaning by wiping) the discharge ports formed surface 51 of the recording head 2 or dummy discharge from the discharge ports 52; to prevent recording apparatus power from being turned off in such state, it is necessary to precisely notify a user whether the cap 16 is in an open state or a close state.

Accordingly, an ink jet recording apparatus to which the present invention is applied is so constructed that when the cap 16 is in an open state, a user is notified of the state by an indicator, and also, a user is notified that a cap mechanism will enter an open state immediately before the state of the cap 16 changes from close to open. Also, according to construction employed, in a recovery operation of the recording head 2 or an operation of sucking ink from inside the cap 16, a user is notified by an indicator or the like that the state of the cap 16 will change from open to close. Furthermore, according to construction employed, a user is notified by an indicator that the cap mechanism will enter an open state immediately before the cap 16 is opened for transition to a recording operation under a command for recording from the host 9.

Figure 5A:
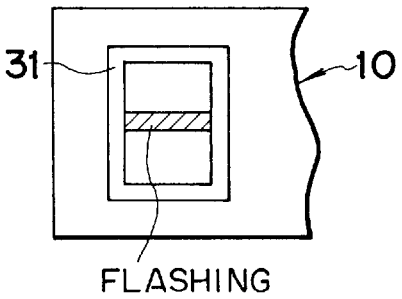
FIGS. 5A and 5B are schematic illustrations showing the indicating operation of an indicator on a panel of an ink jet recording apparatus to which an embodiment according to the present invention is applied.
Figure 5B:
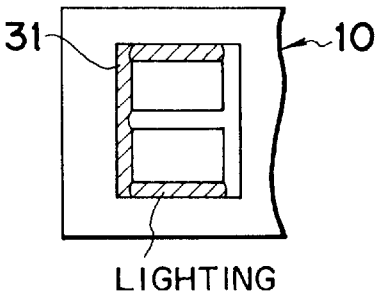
Figure 6A:
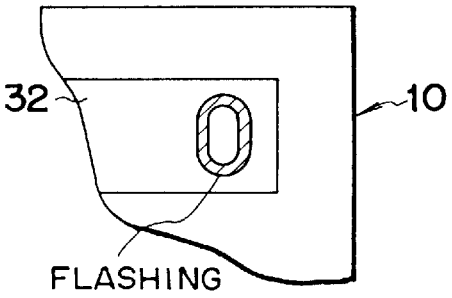
FIGS. 6A and 6B are schematic illustrations showing another state of the indicating operation of an indicator on a panel of an ink jet recording apparatus to which an embodiment according to the present invention is applied.
Figure 6B:
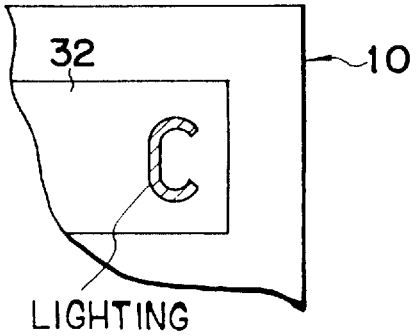

FIGS. 5 and 6 are schematic illustrations showing the construction and operation of the indicators 31 and 32 for indicating the open-close state of the cap 16 and a transitional state in between the aforementioned states, respectively; FIGS. 5A and 5B show the case of using a segment display, and FIGS. 6A and 6B show the case of using a liquid crystal display.

A segment indicator 31 is provided on the panel 10, and is so constructed that a part of indication flashes or lights up as shown in FIG. 5A when the cap 16 is in an open state, and the indication "C" is lit as shown in FIG. 5B when the cap 16 has securely entered a close state, thus precisely notifying a user of the open-close state of the cap 16.

Also, in FIGS. 6A and 6B, a liquid crystal display 32 is provided on the panel 10, and is so constructed that the least significant digit or the like of the digit display thereof is used for indicating the open-close state of the cap 16 by a simple message. According to an illustrated example of construction, the indication "O" flashes as shown in FIG. 6A when the cap 16 is in an open state, and the indication "C" is lit as shown in FIG. 6B when the cap 16 has securely entered a close state, thus precisely notifying a user of the open-close state of the cap 16. Furthermore, the method for indicating the open-close state of the cap 16 and the contents of indication are not limited to examples in FIGS. 5A, 5B, 6A and 6B, but can assume various other conditions.

Figure 7:
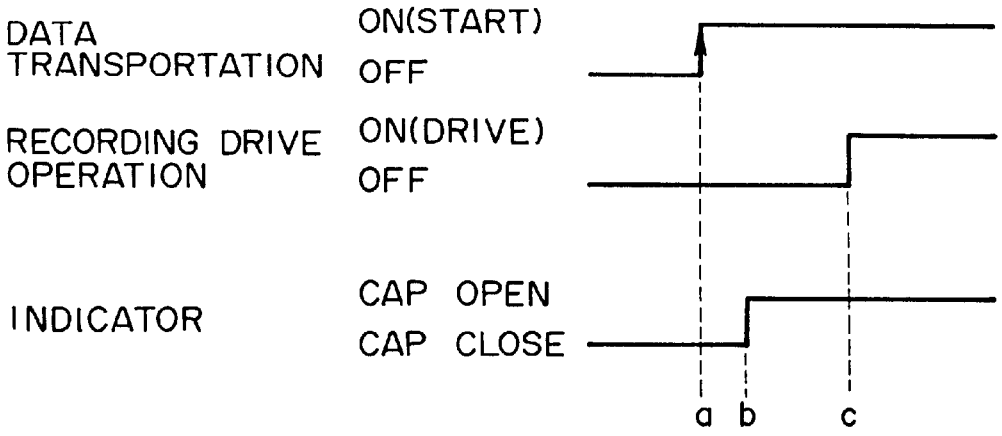
FIG. 7 is a timing chart showing operations at recording operation start-up of an ink jet recording apparatus to which an embodiment according to the present invention is applied.
Figure 8:
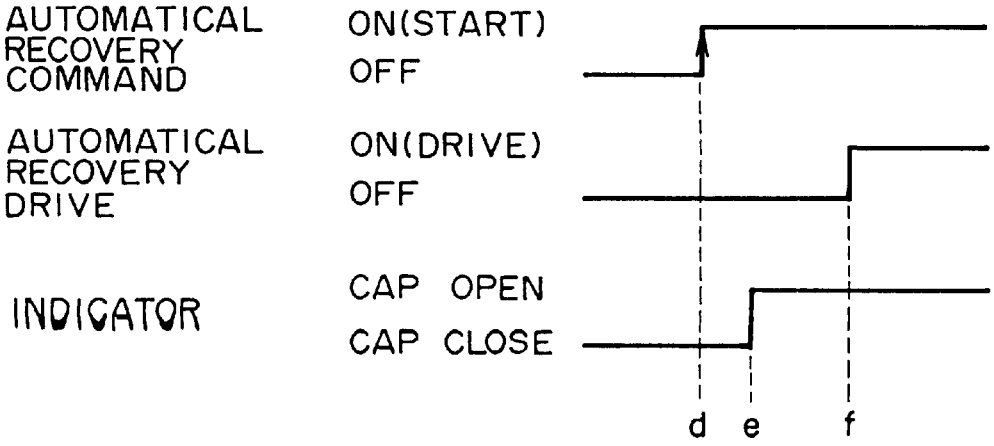
FIG. 8 is a timing chart showing operations at recovery operation start-up of an ink jet recording apparatus to which an embodiment according to the present invention is applied.

FIGS. 7 and 8 are timing charts exemplifying the operation of previously notifying a user that the cap 16 will enter an open state for preventing recording apparatus power from being turned off in the midst of the cap 16's transition from a close state to an open state, respectively; FIG. 7 shows the case wherein a recording operation is started in an on-line state, and FIG. 8 shows the case wherein a recovery operation is started.

In FIG. 7, when receiving data from the host 9 starts (at time a) in an on-line state, first, the indicator 31 or 32 is made to indicate at time b that the cap is in an open state, and then, a recording drive system is made to start to operate at time c. By employing such control operation, recording apparatus power is prevented from being turned off after the recording drive system has started to operate.

Also, in FIG. 8, when a recovery operation start signal (automatic recovery command) is issued at time d, first, the indicator 31 or 32 is made to indicate at time e that the cap is in an open state, and then, the drive of a recovery operation (automatic recovery drive), including the operation of opening the cap 16, is started. In other words, when a recovery operation is automatically performed for discharge stability under the management of a timer or after every predetermined operation, control is exercised so as to previously (at time e) indicate by the indicator 31 or 32 that the cap 16 will be opened, and then start to drive a recovery operation. By employing such control operation, a user can previously recognize that the cap will be opened, thus securely preventing recording apparatus power from being turned off after a recovery operation has started, i.e. preventing a user from turning power off when the cap is in an open state.

According to an embodiment described above, the indicator 31 or 32 always indicates the state of capping (whether the cap is in an open state or a close state) of the recording head 2, and hence, a user can precisely determine the timing of turning apparatus power off after recognizing the state of capping; as a result, recording apparatus power is prevented from being turned off when the cap is in an open state, thus attaining the subsequent stability of ink discharge from the recording head 2 and preventing ink leakage in transit.

Next, another embodiment of the present invention will be described with reference to the drawings.

Figure 9:
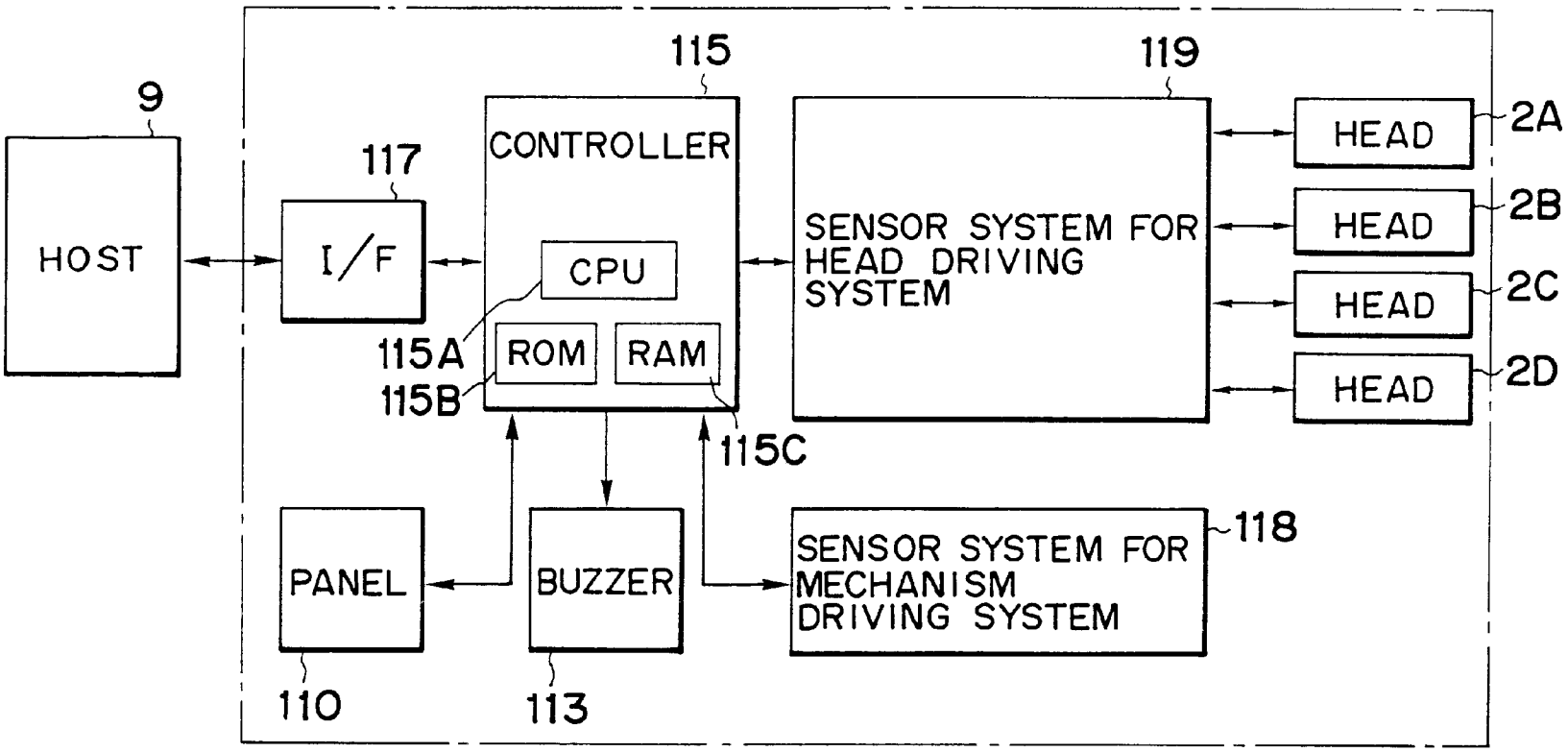
FIG. 9 is a block diagram showing an example of the construction of the essential portions of a control system of an ink jet recording apparatus to which another embodiment according to the present invention is applied.

FIG. 9 is a block diagram of the construction of essential portions of an ink jet recording apparatus 1 in FIG. 1. In FIG. 9, the controller 115 of the recording apparatus 1 is provided with a CPU 115A, a ROM 115B and a RAM 115C, and this controller 115 is connected to a host 9 such as a computer or the like through an interface 117. Also, according to the construction employed, said controller 115 is connected to said panel 110 and a mechanism driving system and sensor system 118 for mutually exchanging signals. Moreover, according to construction employed, said controller 115 is connected to said recording heads 2A through 2D through a head driving system and sensor system 119 for controlling the recording operation of the recording heads 2A through 2D while mutually exchanging signals. Also, according to the construction employed, a buzzer 113 is connected to said controller 115 for enabling a user to recognize the state of capping of the recording head 2.

Accordingly, a control system in FIG. 9 is so constructed as to forcibly execute the closing (capping) of the recording head 2 with the cap 16, and execute, according to the state of capping (whether or not closing with the cap has been done securely), at least one of the operation of indicating a close state (capped state) on the panel 110 and the operation of driving the buzzer 113 for telling a capped state, thereby quickly and securely notifying a user of the state of capping (whether or not closing with the cap has been done securely) of the ink discharge portion.

Figure 10:
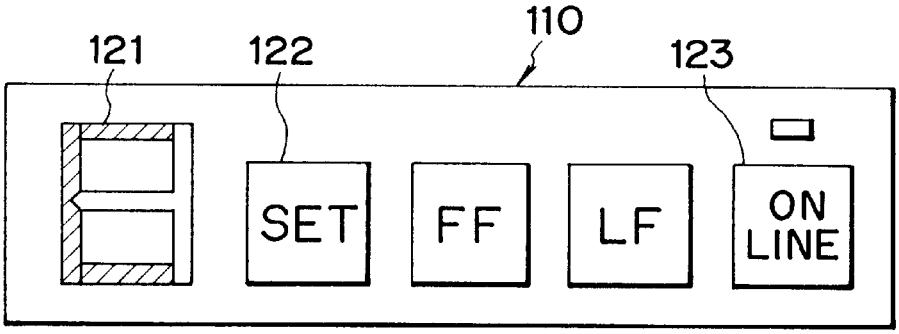
FIG. 10 is a schematic illustration showing an example of the construction of a panel for operation and indication of an ink jet recording apparatus to which another embodiment according to the present invention is applied.
Figure 11:
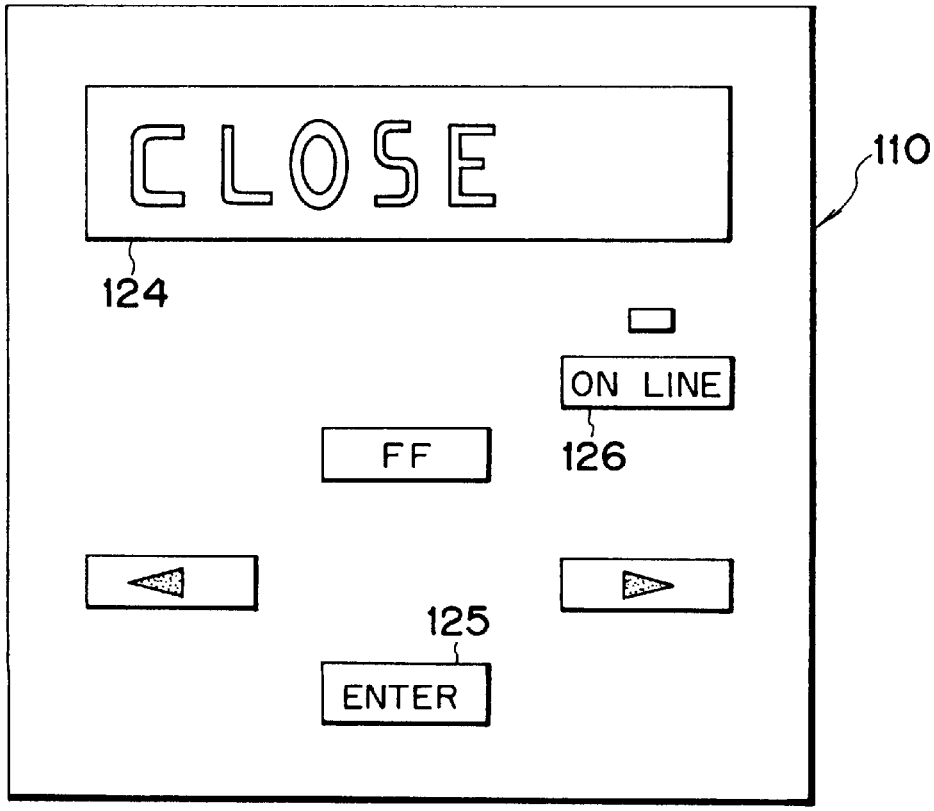
FIG. 11 is a schematic illustration showing an example of another construction of a panel for operation and indication of an ink jet recording apparatus to which another embodiment according to the present invention is applied.

FIGS. 10 and 11 are front views showing the construction of the panel 110 for operation and display when the recording head 2 is forcibly capped (closed); FIG. 10 shows the case of using a segment display, and FIG. 11 shows the case of using a liquid crystal display.

In FIG. 10, a segment indicator 121, a set switch 122, and an on-line switch 123 are provided on the panel 110, and are so constructed that pressing (turning on) the on-line switch 123 and the set switch 122 concurrently causes the operation of forcibly closing (capping) the recording head 2 to be executed, and the indicator 121 indicates "C" when closing the ink discharge portion has been completed.

Also in the panel 110 in FIG. 11, a liquid crystal indicator 124, an enter switch 125, and an on-line switch 126 are provided, and are so constructed that pressing (turning on) the on-line switch 126 and the enter switch 125 concurrently causes the operation of forcibly closing (capping) the recording head 2 to be executed, and "CLOSE" appears on the liquid crystal indicator 124 when closing the ink discharge portion has been completed.

A delivery inspection in a production line in a factory can employ the procedure that after executing various kinds of test prints, the aforementioned operation of forcibly closing (forcibly capping) the recording head 2 is securely and quickly executed, and then, the recording apparatus 1 is packed. Furthermore, the indication of the completion of capping (closing the ink discharge portion) in this case is the same as in the case of panel operation.

Figure 12:
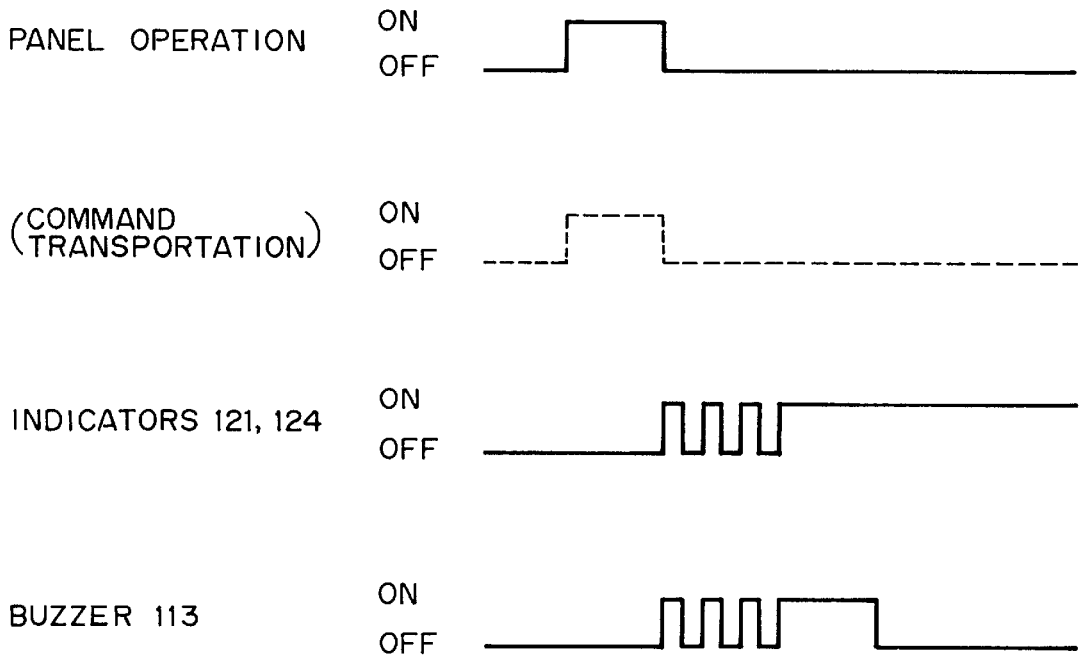
FIG. 12 is a timing chart of operations of individual portions at the forced capping of an ink jet recording apparatus to which another embodiment according to the present invention is applied.

FIG. 12 is a timing chart for the aforementioned operation of forcibly closing (capping) the recording head 2. In FIG. 12, when executed is a panel operation (forced capping operation) comprising the operation of concurrently pressing (turning on) the set switch 122 and the on-line switch 123 on the panel 110 or the operation of pressing (turning on) the enter switch 125 and the on-line switch 126, a command is transferred from the host 9 to the controller 115 of the recording apparatus 1 for executing the operation of forcibly closing (capping) the recording head 2. When this closing operation starts, said indicator 121 or 124 starts to flash, and when this closing operation is completed, the indication of said indicator 121 or 124 changes from flashing to constant lighting. Such operations enable a user to quickly and securely recognize the operation of capping the recording head 2 and the completion of capping.

In addition, practicable is the construction that, as shown in FIG. 12, the buzzer 113 is also used in addition to said indicator 121 or 124 for notifying a user of a capping operation and the completion of capping by means of a combination of buzzer sound and an indicator. In such a case, for example, as illustrated, by changing the sound frequency of the buzzer 113 between the time when indicator 121 or 124 flashes indicating the execution of a closing operation and the time when said indicator lights up indicating the completion of a closing operation, a user can also quickly and securely recognize the completion of a closing operation (capping operation) from a buzzer sound.

As described above, by additionally using the buzzer 113, a user can recognize the completion of a closing operation from a change of the frequency of the buzzer sound or the like without observing the indicator 121 or 124 after a panel operation has been executed, and also, a user can reconfirm the completion of a closing operation by observing the indicator 121 or 124 when turning power off, thus enabling various kinds of settings; hence, operability can be improved better than the case of using an indicator only. Moreover, the same is true of commands from a host. Also, the method for a panel operation and the type of switches are not limited to an illustrated example, but can be implemented at various other settings.

Furthermore, the aforementioned embodiment has been described taking an example of a serial type ink jet recording apparatus wherein the recording means (recording head) 2 is mounted on the carriage 3, and main scanning is conducted along the recording material 7; in addition, the present invention is also applicable in similar fashion to line type ink jet recording apparatuses which use line type recording means corresponding to a part of or entire recording width of recording material, and can accomplish similar effects. Also, the aforementioned embodiment has been described taking an example of an ink jet recording apparatus for color recording which uses a plurality of recording heads for recording in ink in different colors; in addition, irrespective of the number of recording heads, the present invention is also applicable in similar fashion, for example, to ink jet recording apparatuses for monochromatic recording, each of which uses one recording head, or ink jet recording apparatus for gradation recording, each of which uses a plurality of recording heads for recording in ink in the same color but different densities, and can accomplish similar effects.

In addition, the recording means (recording head) 2 may employ the construction that a recording head and an ink tank are integrated into one unit, the construction that a recording head and an ink tank are made separate units mutually connected with an ink feed tube, or other constructions, but no matter how the recording means and ink tanks are constructed, the present invention is applicable in similar fashion, and can accomplish similar effects.

The present invention is applicable to ink jet recording apparatuses which use recording means (recording head) using electrothermal conversion bodies or the like such as piezoelectric elements or the like, and especially, brings about an excellent effect when applied to ink jet recording apparatuses employing the system of utilizing thermal energy for discharging ink. This is because such a system can accomplish recording at high density and high definition.

For the typical construction and principle of such a system, it is preferable to use, for example, a basic principle disclosed in U.S. Pat. No. 4,723,129 or U.S. Pat. No. 4,740,796. The system is applicable to either so-called on-demand type or continuous type. In particular, in the case of on-demand type, at least one driving signal which corresponds to recording information and causes a sharp temperature rise exceeding nucleate boiling is applied to electrothermal conversion bodies arranged in correspondence with a liquid (ink) holding sheet and liquid paths, thereby causing thermal energy to be generated in an electrothermal body and causing film boiling to occur on the heat acting surface of a recording means (recording head) with a resultant formation of a bubble in liquid (ink) in one-to-one correspondence with this driving signal.

The growth and contraction of a bubble causes liquid (ink) to be discharged through an opening for discharge, thereby forming at least one droplet. If this driving signal is in pulse form, the growth and contraction of a bubble is conducted quickly and appropriately, thereby achieving liquid (ink) discharge excellent especially in response performance; therefore, the driving signal in pulse form is more preferable. Signals as described in U.S. Pat. No. 4,463,359 and U.S. Pat. No. 4,345,262 are suited to be used as this pulse-form driving signal. Also, if used are conditions described in U.S. Pat. No. 4,313,124 for an invention relating to a temperature-rise rate of the heat acting surface described above, more excellent recording will be able to be conducted.

A recording head construction of the present invention includes a construction using U.S. Pat. No. 4,558,333 and U.S. Pat. No. 4,459,600 disclosing the construction that a heat acting portion is disposed in a curved region, in addition to a combined construction of discharge ports, liquid paths, and electrothermal conversion bodies (linear liquid paths or right-angled liquid paths) as disclosed in each patent described above. In addition, the effect of the present invention still works for constructions based on Japanese Patent Application Laid-Open No. 59-123670 disclosing the construction that a common slit for a plurality of electrothermal conversion bodies is used as a discharge portion for the electrothermal conversion bodies and Japanese Patent Application Laid-Open No. 59-138461 disclosing the construction that apertures absorbing pressure waves of thermal energy correspond to discharge portions. In other words, whatever form the recording heads assume, the present invention enables recording to be conducted securely and efficiently.

Moreover, the present invention is effectively applicable to a full-line type recording head having a length corresponding to the maximum width of a recording material (recording medium) recordable by a recording apparatuses. Such a recording head may be either of a combined construction of a plurality of recording heads for attaining a required length and/or a construction of a single integrally formed recording head. In addition, the present invention is also effective in the case of using a recording head fixed on an apparatus main body, or a replaceable, chip type recording head whose installation onto an apparatus main body establishes electrical connections with the apparatus main body and ink supply from the apparatus main body, or a cartridge type recording head, i.e. a recording head integrally provided with an ink tank, all said recording heads being of a serial type as exemplified above.

For the reason of further stabilizing the effect of the present invention, it is preferable to add recovery means for a recording head, preliminary auxiliary means and the like that are provided in the present invention as the construction of a recording apparatuses. Specifically speaking, capping means, cleaning means, and pressurizing or sucking means for a recording head, preliminary heating means with electrothermal conversion bodies or other heating elements or their combination, and means for conducting a preliminary discharge mode, i.e. conducting discharge other than for recording, are also effective for stable recording.

Also, as for the type or quantity of recording heads to be mounted, for example, only one recording head need be provided in correspondence with monochromatic ink, or a plurality of recording heads can be provided in correspondence with a plurality of inks of different recording colors and densities. In other words, for example, the present invention is also quite effective for a recording apparatuses having, as a recording mode thereof, not only a recording mode in a main color only, such as black or the like, but at least either a multiple-color recording mode in different colors or a full-color recording mode in mixed colors, said multiple-color and full-color recording modes being attained either by an integrally constructed recording head or a plurality of recording heads combined.

Furthermore, in embodiments of the present invention described above, ink is described as liquid; however, also acceptable is ink that solidifies at room temperature or below and softens or liquefies at room temperature, or ink that is in liquid phase at the time of applying a recording signal used, since in an ink jet system, the temperature of ink itself is usually controlled at a temperature ranging from 30° C. to 70° C. for maintaining ink viscosity in a range of stable discharge. In addition, thermal energy can be positively used as energy for changing the phase of ink from solid phase to liquid phase for preventing a temperature rise caused by thermal energy, or for preventing ink evaporation, when ink is used which solidifies if left as is. The present invention is also applicable to the case wherein thermal energy applied in accordance with a recording signal causes ink to liquefy, and then the liquefied ink is discharged, and the case wherein ink is used which does not liquefy until thermal energy is applied thereto, for example, such ink that already begins to solidify at the time of reaching a recording medium.

The present invention is the most effective for each ink described above when a film boiling system described above is executed.

Furthermore, an ink jet recording apparatuses according to the present invention may assume the form of an image output terminal for information processing equipment such as computers and the like, a copying machine combined with a reader and the like, facsimile equipment having a transmission-reception feature, and so on.

What is claimed is:

1. An ink jet recording apparatus for recording on a recording medium by using recording means for discharging ink through an ink discharge portion, said apparatus comprising:

a cap for capping the ink discharge portion;

moving means for moving said cap and the recording means relative to each other between an open state in which the ink discharge portion is not capped and a closed state in which the ink discharge portion is capped;

means for prompting a user to recognize a state of opening or of closing said cap; and means for controlling the recording means and said moving means and, when performing at least one control process which will involve a change of the state of said cap, for causing said means for prompting the user to provide an indication of the change until the change of state is complete.

2. An ink jet recording apparatus according to claim 1, wherein said means for prompting the user comprises a visual indicator.

3. An ink jet recording apparatus according to claim 1, wherein said means for prompting the user indicates that the state of said cap will change from the open state to the closed state in a recovery operation of the recording means or an operation of sucking ink from inside said cap.

4. An ink jet recording apparatus according to claim 1, wherein said means for prompting the user indicates that said cap will enter the open state immediately before said cap is opened for transition to a recording operation under a command for recording from a host.

5. An ink jet recording apparatus according to claim 1, wherein said ink discharge portion is forcibly closed with said cap by an external operation.

6. An ink jet recording apparatus according to claim 1, wherein said recording means comprises an ink jet recording head having an electrothermal conversion body for generating thermal energy for ink discharge.

7. An ink jet recording apparatus according to claim 6, wherein said recording head utilizes film boiling in ink caused by thermal energy being applied by said electrothermal conversion body for discharging ink from discharge ports thereof.

8. An ink jet recording apparatuses according to claim 1, wherein said means for prompting the user begins to indicate that said cap is in the open state after receiving a signal indicating that recording is to be effected but before recording begins.

9. An ink jet recording apparatus according to claim 1, wherein said means for prompting the user begins to indicate that said cap is in the open state after receiving a signal that a recovery operation is to be effected on the recording means but before the recovery operation begins.

10. A method of operation of an ink jet recording apparatuses using recording means for discharging ink through an ink discharge portion and a cap movable between a closed state for capping the ink discharge portion and an open state, said method comprising the steps of:

performing a control process including a change of state of the cap; and prompting a user to recognize a state of opening or of closing said cap until the change of state is complete.

11. A method according to claim 10, wherein said prompting step comprises visually indicating.

12. A method according to claim 10, wherein said prompting step further comprises indicating that the state of the cap will change from the open state to the closed state in a recovery operation of the recording means or an operation of sucking ink from inside the cap.

13. A method according to claim 10, wherein said prompting step further comprises indicating that the cap will enter the open state immediately before the cap is opened for transition to a recording operation under a command for recording from a host.

14. A method according to claim 10, wherein the ink discharge portion is forcibly closed with the cap by an external operation.

15. A method according to claim 10, wherein said prompting step further comprises beginning to indicate that the cap is in the open state after a signal is received indicating that recording is to be effected but before recording begins.

16. A method according to claim 10, wherein said prompting step further comprises beginning to indicate that the cap is in the open state after a signal is received that a recovery operation is to be effected on the recording means but before the recovery operation begins.

17. An ink jet recording apparatus for recording on a recording medium by using recording means for discharging ink through an ink discharge portion, said apparatus comprising:

a cap for capping the ink discharge portion of the recording means;

means for prompting a user to recognize a state of opening or of closing said cap; and means for notifying, during a change between an open state of said cap and a closed state of said cap, the state of said cap to which the change will be made.

18. A method for operating an ink jet recording apparatus using recording means for discharging ink through an ink discharge portion and a cap movable between a closed state for capping the ink discharge portion and an open state, said method comprising the steps of:

performing a control process including a change of state of the cap; and informing that the cap is being shifted from the closed state to the open state, after commencement of a drive of the cap to the open state by a mechanism for opening and closing the cap, until the cap is moved from the closed state to the open state.

19. A method according to claim 18, wherein said informing step comprises visually indicating.

20. A method according to claim 18, wherein said informing step further comprises indicating that the state of the cap will change from the open state to the closed state in a recovery operation of the recording means or an operation of sucking ink from inside the cap.

21. A method according to claim 18, wherein said informing step further comprises indicating that the cap will enter the open state immediately before the cap is opened for transition to a recording operation under a command for recording from a host.

22. A method according to claim 18, wherein the ink discharge portion is forcibly closed with the cap by an external operation.

23. A method according to claim 18, wherein said informing step further comprises beginning to indicate that the cap is in the open state after a signal is received indicating that recording is to be effected but before recording begins.

24. A method according to claim 18, wherein said informing step further comprises beginning to indicate that the cap is in the open state after a signal is received that a recovery operation is to be effected on the recording means but before the recovery operation begins.

25. A method for operating an ink jet recording apparatus using recording means for discharging ink through an ink discharge portion and a cap movable between a closed state for capping the ink discharge portion and an open state, said method comprising the steps of:

performing a control process including a change of state of the cap; and informing that the cap is at an open state before the cap is driven to the open state by a mechanism for opening and closing the cap.

26. A method according to claim 25, wherein said informing step comprises visually indicating.

27. A method according to claim 25, wherein said informing step further comprises indicating that the state of the cap will change from the open state to the closed state in a recovery operation of the recording means or an operation of sucking ink from inside the cap.

28. A method according to claim 25, wherein said informing step further comprises indicating that the cap will enter the open state immediately before the cap is opened for transition to a recording operation under a command for recording from a host.

29. A method according to claim 25, wherein the ink discharge portion is forcibly closed with the cap by an external operation.

30. A method according to claim 25, wherein said informing step further comprises beginning to indicate that the cap is in the open state after a signal is received indicating that recording is to be effected but before recording begins.

31. A method according to claim 25, wherein said informing step further comprises beginning to indicate that the cap is in the open state after a signal is received that a recovery operation is to be effected on the recording means but before the recovery operation begins.

* * * * *